United States Patent [19]

deBin

[11] Patent Number: 4,758,214

[45] Date of Patent: Jul. 19, 1988

[54] TWIN WICKETING BAG MACHINE

[75] Inventor: René F. deBin, Aalst, Belgium

[73] Assignee: FMC Corporation, Chicago, Ill.

[21] Appl. No.: 48,183

[22] Filed: May 11, 1987

Related U.S. Application Data

[60] Division of Ser. No. 816,692, Jan. 6, 1986, Pat. No. 4,693,701, which is a continuation of Ser. No. 528,926, Sep. 12, 1983, abandoned.

[51] Int. Cl.[4] ..... B31B 23/14; B31B 1/98

[52] U.S. Cl. ..... 493/204; 83/29; 83/30; 83/35; 83/39; 83/91; 83/95; 83/171; 83/255; 83/278; 493/196; 493/198; 493/227; 493/372; 493/920

[58] Field of Search ..... 83/19, 29, 30, 35, 39, 83/88, 91, 94, 95, 161, 171, 176, 255, 278, 459, 681; 156/510, 515; 493/193–197, 199, 203, 204, 226–228, 230, 242, 238, 263, 372, 341, 470, 926

[56] References Cited

U.S. PATENT DOCUMENTS

| | | | |
|---|---|---|---|
| 3,136,193 | 6/1964 | Gantz | 83/639 |
| 3,590,695 | 7/1971 | Gerard | 83/678 |
| 3,739,965 | 6/1973 | Jespersen et al. | 83/678 |
| 3,835,754 | 9/1974 | Lewyckyj | 83/678 |
| 4,018,116 | 4/1977 | Treffner et al. | 83/171 |
| 4,181,069 | 1/1980 | Porter | 493/204 |
| 4,285,681 | 8/1981 | Walitalo et al. | 493/194 |
| 4,292,033 | 9/1981 | Wolske | 493/204 |
| 4,371,365 | 1/1983 | Shingo | 493/204 |
| 4,386,465 | 6/1983 | Ezaki | 83/459 |
| 4,395,252 | 7/1983 | Lemacher | 493/204 |
| 4,451,249 | 5/1984 | deBin | 493/196 |
| 4,459,172 | 7/1984 | Achelpohl et al. | 493/204 |
| 4,487,599 | 12/1984 | Bendig et al. | 493/194 |

*Primary Examiner*—Frank T. Yost
*Assistant Examiner*—Hien H. Phan
*Attorney, Agent, or Firm*—Raymond E. Parks; Douglas W. Rudy; Richard B. Megley

[57] ABSTRACT

This application discloses a method and apparatus for converting thermoplastic web material, flat or tubular, to produce bags. A conventional bag machine produces web segments provided with a group of centrally located holes and each segment is transferred by a conventional rotary transfer device to one of a plurality of platforms which are sequentially located at a stacking station. The platforms are provided with upwardly projecting pins on which the web sections are stacked. After the accumulation of a desired number of web segments on the platform located at the stacking station, the loaded platform is indexed away from the stacking station to a perforating station and then to a cutting or cutting and blocking station to thereby produce two bag stacks, each of which are retained on the associated platform by the pins.

7 Claims, 6 Drawing Sheets

TWIN WICKETING BAG MACHINE

This is a division of application Ser. No. 06/816,692 filed Jan. 6, 1986, U.S. Pat. No. 4,693,701 which is a continuation of application Ser. No. 06/528,926, filed Aug. 12, 1983, abandoned.

This invention relates to equipment for converting thermoplastic films and more particularly to converting equipment that produces thermoplastic bags.

The disclosure of the present application is related to and is an improvement to the subject matter disclosed in U.S. application Ser. No. 304,405, filed 21 Sept., 1981 now U.S. Pat. No. 4,451,249, and assigned to the assignee of the present application.

The mentioned application discloses a bag making procedure in which the elongate strip of thermoplastic web is provided with lines of perforation located centrally of the web strip. Each segment produced by the action of the seal bar contains the centrally located lines of perforation. In transporting the web segment by a rotary transfer device, from the pickup station to the stacking station containing the upwardly projecting pins, partial or full separation along a line of perforation sometimes occurs. If full separation occurs while the web segment is in transit to the stacking station, stacking of that web segment cannot be achieved since registration with the stacking post is no longer possible. In the event partial separation occurs and stacking on the post is achieved a portion of that web segment may not lie in a position to produce a bag stack having the edges of each individual bag overlying each other.

According to the present invention the web segments transferred to the stacking posts are absent of any perforations and thus clearly obviate the problem of premature partial or total tearing along the lines of perforation. In fulfilling this feature the present invention proposes to effect perforation of a complete stack of web segments while they are retained on the stacking posts or pins and subsequently, at an adjacent station, effect cutting of the perforated web segments at an adjacent downstream station.

U.S. application Ser. No. 304,405 now U.S. Pat. No. 4,451,249 discloses, in FIGS. 9 and 10, a cutting station substantially similar to the cutting station disclosed herein.

FIGS. 1A and 1B, considered together, is a side elevation of a web processing machine constructed and operating in accordance with the principles of the present invention, FIG. 2 is a perspective illustrating the mechanism involved for transferring a web segment from a transfer station to the stacking station, FIG. 3 is a perspective illustrating a stack of web segments deposited on pins carried by a stacking plate, FIG. 4 is similar to FIG. 3 but additionally shows the perforating knives after perforation of the stacked web segments has occurred, FIG. 5 illustrates the web segments being cut between the pins by a knife to produce two bag stacks, FIG. 6 is a side elevation of the knife supporting and actuating means, FIG. 7 is a section of FIG. 6 taken substantially along the line 7—7.

Figure 1A:
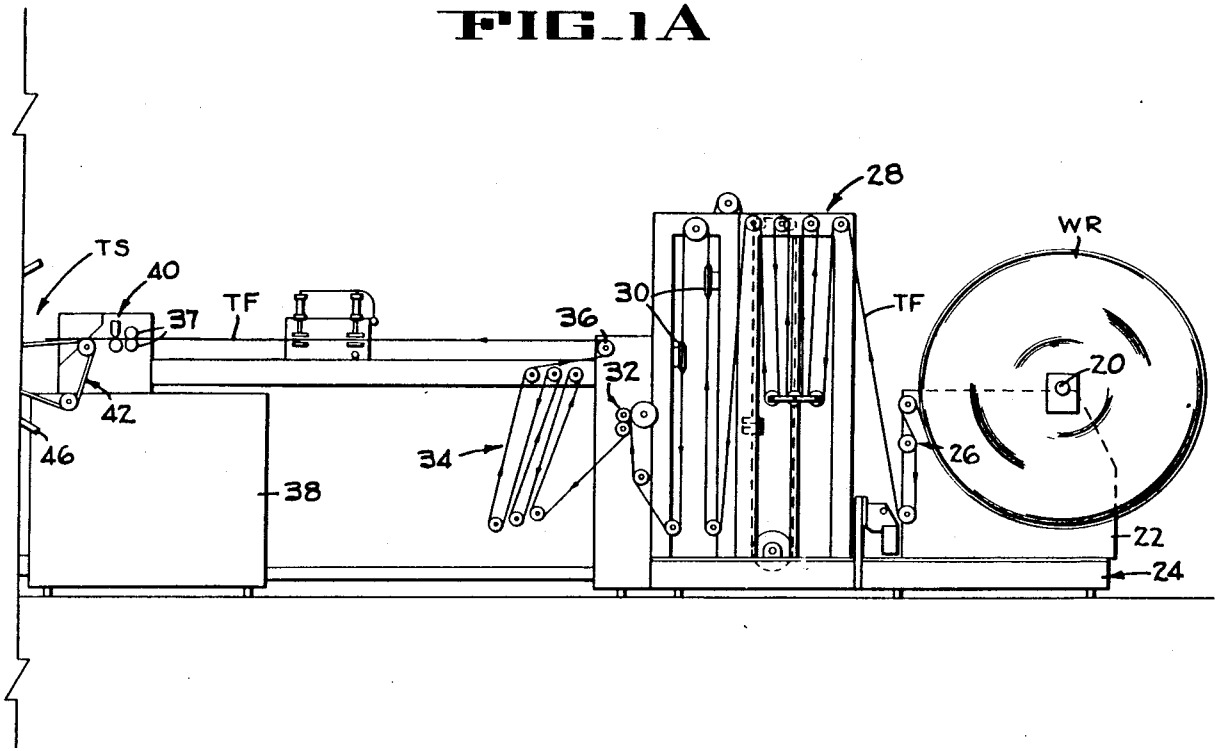

Referring first to FIG. 1A it will be seen that a web roll WR is mounted on a transverse shaft 20 rotatably supported by an unwind stand 22 carried by a frame structure 24. The web strip unwound from the web roll WR passes over a series of rolls collectively identified by the numeral 26 and then progresses over a serial of rolls rotatably mounted in a tower structure 28 which includes gusseting devices 30. Unreeling of the web strip from the web roll is accomplished by drive rolls 32 and thereafter the web is passed over a series of rolls comprising a web tensioning device 34. A turning roll 36 directs the web strip to draw rolls 37 which are intermittently operated by the drive of a bag machine 38.

The thermoplastic film TF is advanced by the draw rolls to a severing and sealing station 40 and the portion of web advanced is momentarily retained on a series of belts 42 generally describing a triangular path and defining a transfer station TS. On creation of a web segment WS located at the transfer station (FIG. 2), a rotary transfer mechanism 44, which includes a plurality of regularly spaced radially extending tubular bars 46, connected through a hub 48 to a source of vacuum, engages and retains a web segment at the transfer station and translates it through an arc for reception by one of a series of stacking devices 50 located at a stacking station 52.

Figure 2:
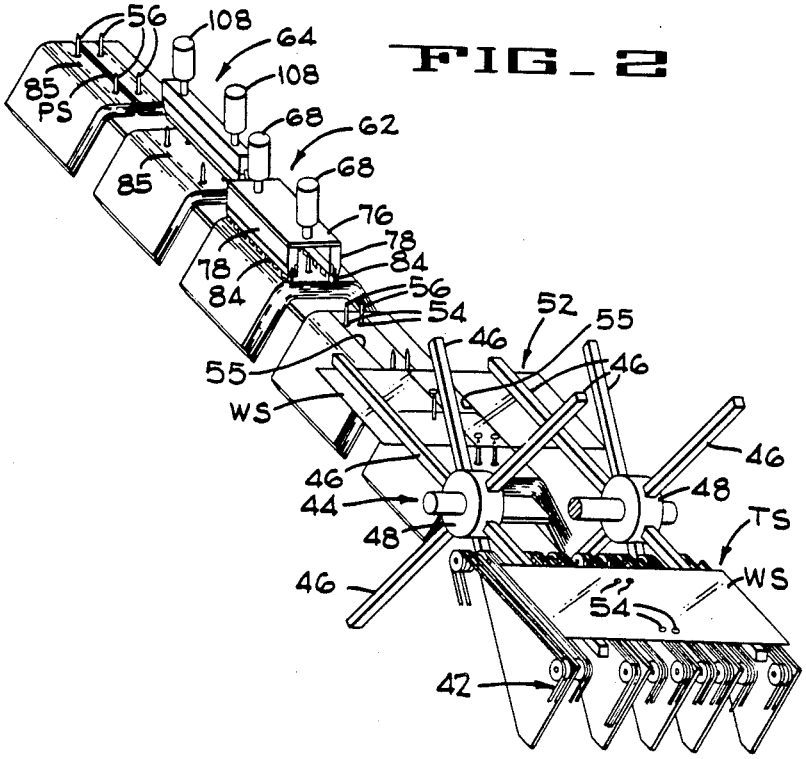

Reference to FIG. 2 will reveal one style of web segment in which each segment has a central medial strip 55 removed from one panel and the remaining panel is provided with four holes 54 through which project stacking pins or posts 56 projecting upwardly and fixed to a base plate of the stacking devices 50. The posts 56 are located to correspond to the spacing of the holes 54 so that each web segment is retained on the stacking devices 50 by the posts 56. During machine operation a selected number of web segments are stacked on the stacking devices 50 and when the predetermined number of web segments has been stacked operation of the bag machine 38 is arrested and concurrently therewith a successive stacking device 50 is positioned at the stacking station 52.

Figure 1B:
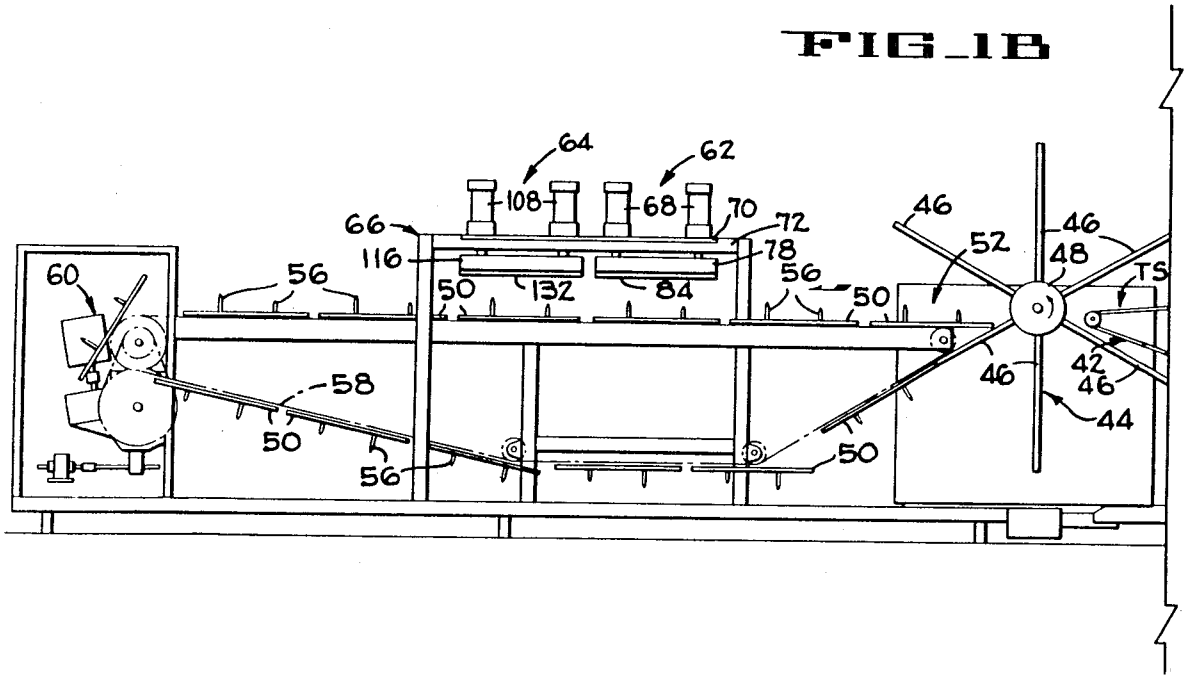

Reference to FIG. 1B will reveal the provision of a conveyor 58 that is intermittently driven by drive mechanism 60 such that the upper reach of the conveyor is incrementally advanced from right to left as viewed in FIG. 1B. Also, as revealed by this Figure, the stacking devices 50 are mounted on the conveyor and successive stacking devices are positioned at the stacking station 52 for a period of time required to accumulate a selected number of web segments.

In accordance with the principal feature of the present invention the problem of premature partial or complete detachment of a portion of a web segment WS, along a line of perforation, does not arise since the web segments produced by the bag machine do not include perforations. Accordingly, forces created by air pressure in the course of transferring a web segment by the transfer device 44 from the transfer station TS to the stacking station 52 is easily tolerated by the web segment. As will be explained presently, the bag stacks produced include perforations but their creation occurs while a stack of web segments is retained on the stacking posts 56 carried by the stacking devices 50.

Further processing of the web segments WS to produce two perforated bag stacks from each group of web segments is achieved by perforating means 62 and cutting means 64 being carried by a frame structure 66 straddling and overlying the conveyor 58. The cutting means 64 are in substantial respects similar to the cutting means disclosed in the above referenced U.S. application Ser. No. 304,405, now U.S. Pat. No. 4,451,249. During the time when a stack of web segments is being accumulated on the stacking device 50 located at the stacking station 52 the conveyor 58 is inactive. During this time period the perforating means 62 and the cutting means 64 are rendered operative, sequentially or concurrently, to effect, respectively, perforation and separation of the accumulated web segments to produce two individual bag stacks each of which contain a line of perforation.

Figure 9:
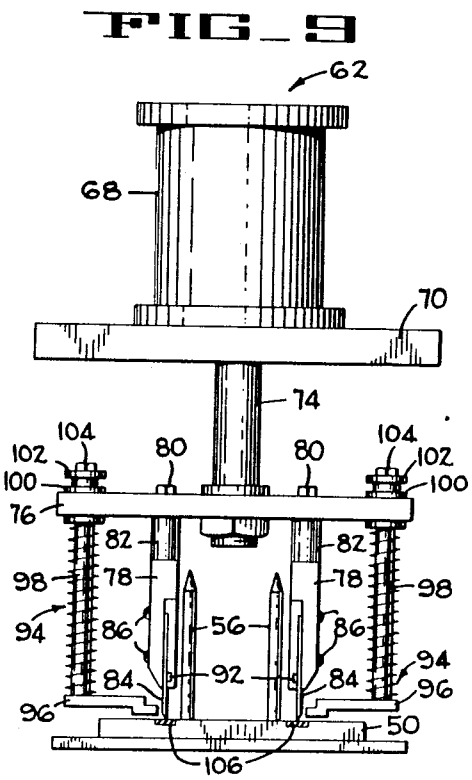
FIG. 9 is a side view of FIG. 8 as viewed along the line 9—9.
Figure 8:
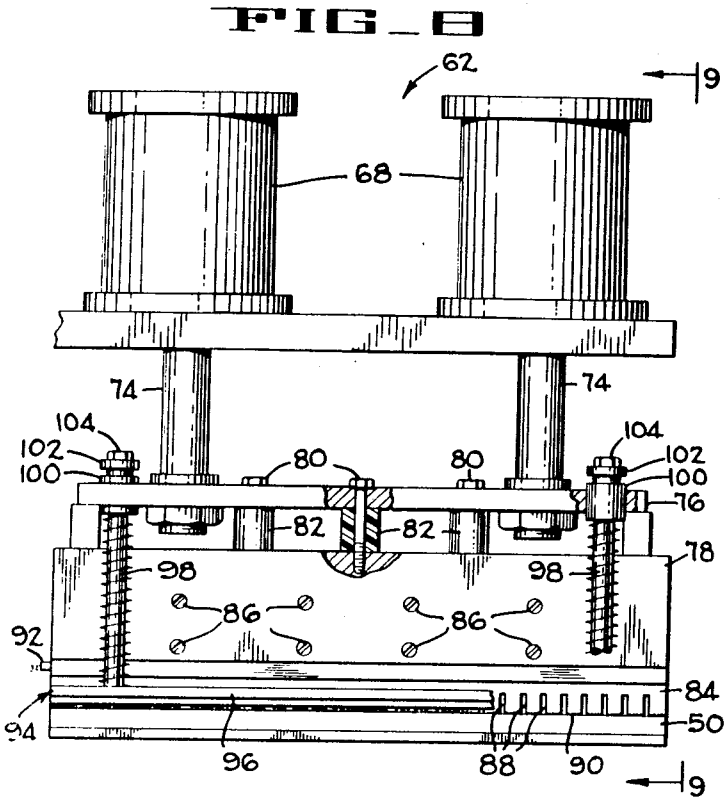
FIG. 8 is an elevation of the perforating mechanism.

The preferred construction of the perforating means 62 is shown in FIGS. 8 and 9 and comprises linear actuators 68 secured to a flat plate 70 which is in turn adjustably secured to horizontal supports 72 (FIG. 1B) of the frame structure 66. The plate 70 is provided with bores through which extend the rods 74 of the linear actuator 68. The extremity of each rod 74 is fixed to a crosshead 76 carrying downwardly projecting perforating knife holders 78. The knife holders 78 are secured to the crossheads 76 by a series of bolts 80 passing through insulating spacer blocks 82 and threaded into the perforating knife holders 78. Perforating knives 84 are secured to the holders 78 by a series of fasteners 86 and the perforating knives 84 extend beyond the holders 78 sufficient to penetrate a stack of web segments. FIG. 8 shows the general configuration of each of the perforating knives, and it will be seen that each knife is provided with a series of slots 88 creating an interruption in the line of cut defined by a cutting edge 90 which may take the form of a jagged edge which experience has shown requires less force to penetrate each stack of web segments. To enhance penetration of the knife 84 each of the perforating knife holders 78 is provided with a slug heater 92 which can be energized to produce a given temperature to each of the knives 84. Heating of the knives 84 has been found to reduce the amount of force necessary to penetrate a stack of web segments and yet the tendency to form a blocked stack does not arise when a sufficiently low temperature level is selected.

Before the perforating knives 84 make contact with the uppermost web segment of the stack of segments, means 94 are provided for compressing the stack to prevent upward bulging of the stack when the knives 84 come into pressure engagement with the stack. As shown in FIGS. 8 and 9 the compressing means 94 include elongate offset bars 96 which are substantially equal in length to the perforating knives 84 and make contact with the stack adjacent the line of perforation established by the knives 84. The bars 96 are connected to the crosshead 76 by spring biased rods 98 which slidably extend through bushings 100 mounted in the crosshead 76. A stop member 102 is secured to the upper end of the rod 98 by a fastener 104 to limit and retain the rods 98 in the bushings 100.

According to the above described arrangement when the actuator 68 is energized to effect operation of the perforating means 62 the elongate bars 96 come in contact with the stack of web segments forcing them downwardly onto the stacking devices 50 and immediately thereafter the perforating knives 84 penetrate and accordingly perforate the stack of web segments.

In order to enhance the longevity of the knives 84 the stacking devices 50 are provided with inserts 106 which can be made of wood or plastic material which will allow penetration of the knives 84 and yet have a minimal effect in rendering the cutting edge of the knives dull.

Figure 7:
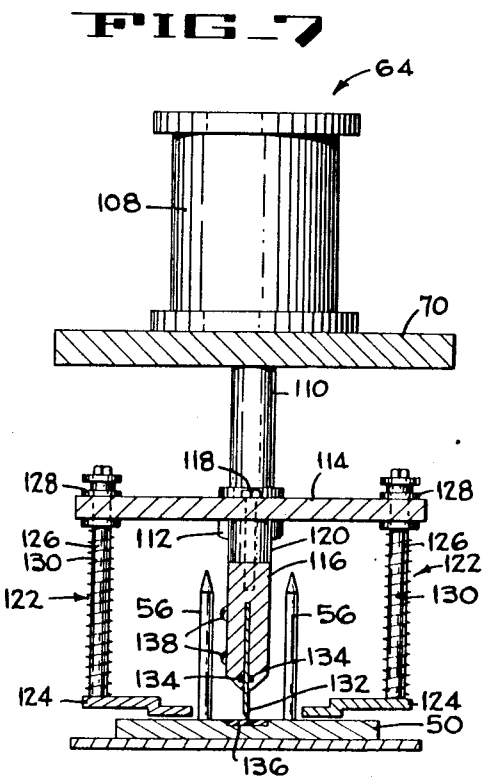
Figure 6:
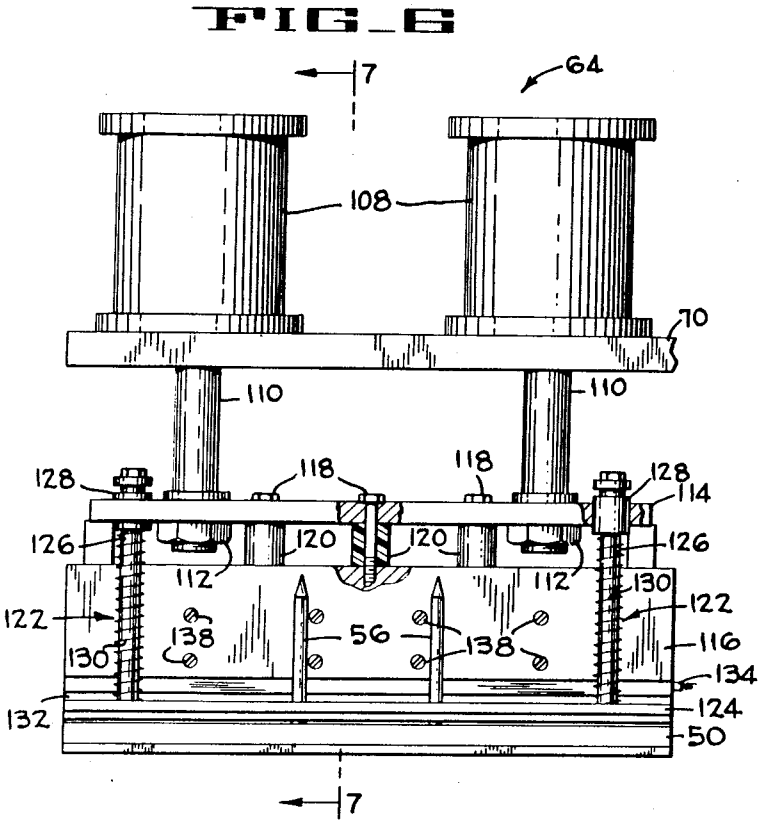

As shown in FIG. 2 the cutting means 64 is located downstream and adjacent the perforating means 62 and if desired the perforating means and the cutting means can be actuated simultaneously or sequentially at the option of the user. FIGS. 6 and 7 illustrate the cutting means 64 in greater detail and it will be seen to comprise linear actuators 108 also mounted on the flat plate 70 being suitably bored to accommodate reciprocating movement of rods 110 having their lower ends threaded to receive a nut 112 fastening the rods to a crosshead 114. A knife holder 116 is in turn connected to the crosshead 114 by bolts 118 extending through insulating spacers 120. In similar respects the cutting means is provided with stack compressing means 122 which include presser bars 124 rigidly connected to rods 126 having their upper ends slidably disposed, by means of bushings 128, to the crosshead 114. Tension springs 130 are associated with each of the rods and serve to bias the presser bars 124 downwardly.

The knife holder 116 is formed to receive and retain a cutting knife 132 and rod heaters 134 serving to heat the knife 132 to a desired temperature to facilitate cutting of the web segments, while they are retained on the pins 56, into two bag stacks each of which include a line of perforation previously made by the perforating means 62. As with the perforating means, cutting means 64 includes, in the stacking device 50, an insert 136 selected of a material such as previously indicated to prevent dulling of the cutting edge of the knife 132. The knife 132 is retained in the holder 116 by a plurality of fasteners 138.

Figure 3:
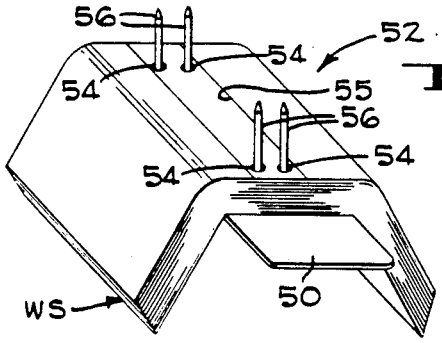
Figure 4:
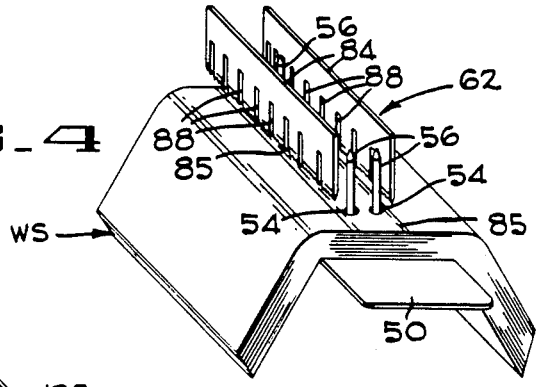
Figure 5:
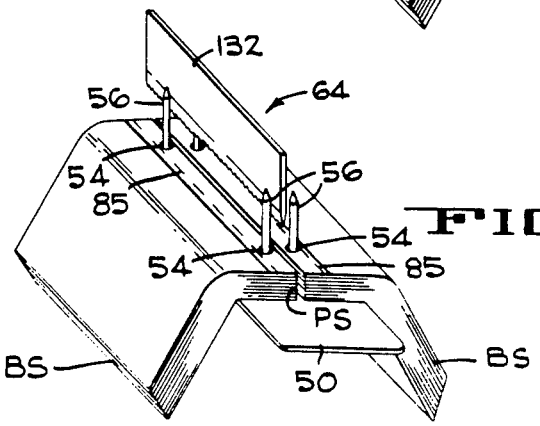

Reference to FIGS. 3, 4 and 5 shows the condition of a stack of web segments at the stacking station 52, the perforating station 62 and the cutting station 64. When the conveyor positions a stack of web segments WS at the perforating station 62 and the actuators 68 are operated to drive the perforating knives 84 to cut the web segments, lines of perforation 85 are produced adjacent the stacking posts 56. As previously mentioned, the cutting station 64, operating the parting knife 132 may be concurrently or subsequently operated to produce two bag stacks BS by cutting the web segments along a line PS, located between the stacking posts 56.

In view of the above described construction of the mode of operation of the over-all machine, and more particularly the perforating means 62 and the cutting means 64, it should be evident that performing the perforating and cutting function after a selected number of web segments have been stacked the problem of the prior art of premature separation along one or more lines of perforation formed in the web segment before stacking does not arise.

What is claimed is:

1. In a bag making apparatus of the type for processing an elongate strip of thermoplastic web material, a method for manufacturing bags comprising the steps of: dividing the web in segments of equal dimensions, providing each segment with at least two pairs of apertures longitudinally spaced and located adjacent to and on either side of an open longitudinal median strip in one flat surface of each segment, transferring the segments over an arcuate path successively to a stacking device provided with two pairs of stacking posts complementary to the apertures in the segment, stacking the successive segments on the posts through the apertures, transporting the stacking device and the stack of segments retained on the posts of the stacking device after accumulating a predetermined number of segments thereon to a perforating device, producing lines of perforation with the perforating device dividing the stack of segments into two bags joined together along the lines of perforation, transporting the stacking device and the stack of perforated segments retained on the posts of the stacking device to a cutting device, cutting the perforated stack of segments with the cutting device along a centerline extending longitudinally between the posts producing two discrete stacks of bags respectively mounted on the longitudinally spaced posts on opposite lateral sides of the centerline.

2. The method according to claim 1, wherein the perforating device comprises: a pair of simultaneously operable linear actuators having actuator rods mounted on a support located above the stack of segments and through which the output rods project, a crosshead fixed to the actuator rods, and means carried by the crosshead for compressing the stack, and including the step of compressing the stack of segments while perforating the stack.

3. The method according to claim 1, wherein the perforating device comprises a holder for carrying the perforating device, advancing means connected to the holder for advancing the perforating device and perforating the stack of segments, and an elongate flat blade-like member clamped to a recess formed in the holder and provided with series of slots interrupting a leading sharpened edge for producing a series of incisions and uncut bond portions in each segment in the stack of segments, and including the steps of heating the blade-like member for facilitating penetration of the thermoplastic web material, and withdrawing the blade-like member with the advancing means after the lines of perforation are effected.

4. The method according to claim 3, wherein the perforating device further comprises a compressing means for compressing the stack of segments along lines adjacent to and parallel with the lines of perforation, and including the step of compressing the stack of segments with the compressing means prior to the heated blade-like member perforating the stack of segments.

5. A method of manufacturing dual thermoplastic bags from a plurality of flattened tubular segments delivered over an arcuate path and draped over a mobile stacking device and held in a stack by longitudinally spaced pairs of pins extending upwardly from the stacking device and engaging longitudinally spaced pairs of holes providing in each segment, comprising the steps of: accumulating a predetermined number of segments on the stacking device over the pins, moving the stacking device after accumulating the predetermined number of segments thereon to a perforating device, perforating the stack of segments with the perforating device along two longitudinal lines of perforation parallel to and spaced laterally outwardly from the pairs of pins thereby defining two stacks of bags joined together along the lines of perforation and draped over lateral opposite sides of the stacking device and mounted to respective pairs of longitudinally spaced pins.

6. The method according to claim 5, wherein the stacking device has two pairs of longitudinally and laterally spaced upright pins and the lines of perforation extend parallel to and are laterally spaced outwardly from the pairs of the longitudinally spaced pins, and further including the step of moving the stacking device to a cutting device after perforating, and severing the perforated stack of bags by the cutting device along a longitudinal centerline between the pins into two individual stacks mounted on respective pairs of the longitudinal spaced pins.

7. The method according to claim 6 including the step of heating the perforating device to a temperature sufficient for easily penetrating the stack without adhering the stack of segments together, and heating the cutting device, prior to severing, to approximately the same temperature for easily severing the stack of segments into the two stack of bags.

* * * * *